United States Patent [19]

Nicol

[11] 3,972,725

[45] Aug. 3, 1976

[54] PRODUCTION OF CRYSTALLINE SUGAR

[75] Inventor: Wilson Menzies Nicol, Reading, England

[73] Assignee: Tate & Lyle Limited, London, England

[22] Filed: Apr. 9, 1975

[21] Appl. No.: 566,617

[30] Foreign Application Priority Data

Apr. 16, 1974 United Kingdom ..... 16572/74

[52] U.S. Cl. ..... 127/58; 127/16; 127/30; 159/28 P; 159/49

[51] Int. Cl.[2] ..... C13F 1/02

[58] Field of Search ..... 127/30, 58, 60, 16

[56] References Cited

UNITED STATES PATENTS

| | | | |
|---|---|---|---|
| 797,965 | 8/1905 | Lagrange | 127/60 |
| 3,247,021 | 4/1966 | Steele | 127/60 X |
| 3,271,194 | 9/1966 | Oikawa | 127/60 |
| 3,365,331 | 1/1968 | Miller | 127/30 |
| 3,503,803 | 3/1970 | Bennett | 127/58 X |
| 3,655,442 | 4/1972 | Schwer | 127/58 |

*Primary Examiner*—Morris O. Wolk
*Assistant Examiner*—Sidney Marantz
*Attorney, Agent, or Firm*—Ostrolenk, Faber, Gerb & Soffen

[57] ABSTRACT

A supersaturated sugar syrup is crystallized following the catastrophic homogeneous nucleation induced by application of a shear force having a velocity gradient of at least 5000 cm/sec/cm, e.g. by a colloid mill or a homogenizer.

20 Claims, 1 Drawing Figure

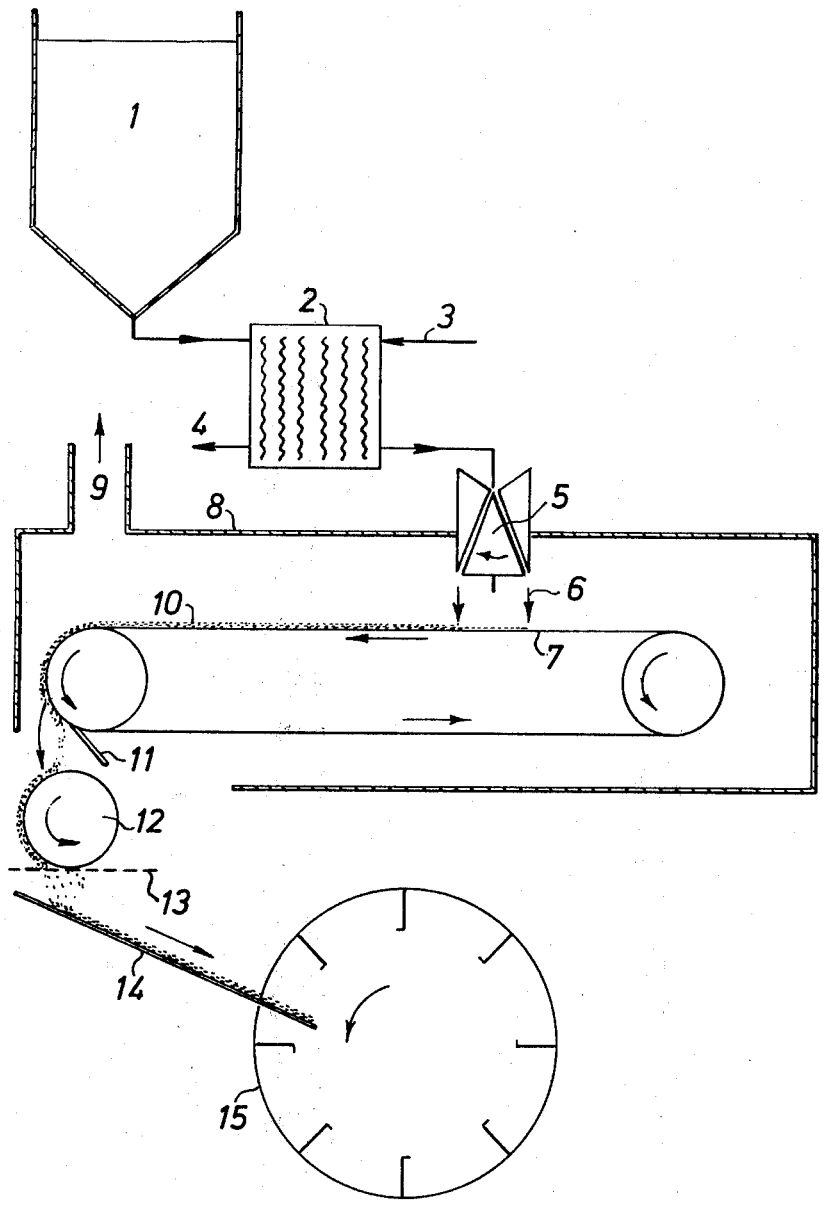
1
2
3
4
5
6
7
8
9
10
11
12
13
14
15

PRODUCTION OF CRYSTALLINE SUGAR

BACKGROUND OF THE INVENTION

The present invention relates to the crystallisation of sugar by a process known as "transformation".

At present, the vast majority of crystalline sugar is produced by charging a hot, concentrated syrup into pans, drawing a vacuum over the pans and evaporating a proportion of the water from the syrup. A portion of the sugar then crystallises out and is separated, generally by a centrifuge. The mother liquor is then reboiled and recycled to produce another crop of sugar crystals. This process may be repeated a number of times until eventually there is produced a final molasses, from which the sugar cannot readily be crystallised; this final molasses is generally unsuitable for human use and usually only finds application as an animal feed or as a source of low grade carbohydrate. Although an extremely pure sugar is produced in the first crop, subsequent crops are of decreasing purity. Moreover, the process is very slow and complex. It has the further disadvantages that it can generally only be operated batch-wise and that it is ordinarily dependent upon the skill and judgement of the operator. A speedier and simpler process would be desirable, even if it is not capable of producing such pure sugar as is obtained in the first crop.

The process of sucrose transformation has been known in theory and practised to a limited extent for some considerable time. In this process, a sugar syrup is concentrated until it becomes supersaturated; aqueous sugar solutions can easily be supersaturated without nucleating simply by evaporative boiling. Nucleation is then induced by mechanical means, causing crystallisation of the sugar. Since sugar has a positive heat of crystallisation, the heat evolved during crystallisation will tend to evaporate water from the solution. Provided a suitable balance of temperature and concentration of the sugar syrup is achieved, essentially complete vaporisation of water can be attained to produce sugar having a very low moisture content. In order to prevent the formation of a solid mass of sugar crystals, it is necessary that the sugar syrup should be kept well agitated during crystallisation; this is normally achieved by stirring, e.g. using paddles, which may themselves provide the required nucleation. Although such a process works satisfactorily, it does not lend itself to continuous operation, and subsequent processing, such as milling and separation, is necessary to generate an acceptable marketable product. Furthermore, as crystallisation proceeds, the energy input necessary to break up the crystallising sugar mass also increases dramatically. The required energy input is so great that the plant necessary for commercial operation has to be massive, thus vitiating any economic advantages over conventional processes. A further disadvantage is the tendency of the crystallising sugar mass to clog apparatus. For these reasons, continuous processes tried have not been very successful.

In addition, the very substantial heat which is liberated during crystallisation will tend, if the sugar crystallises in bulk, to cause caramelisation, unless complicated means are adopted to reduce temperature.

BRIEF SUMMARY OF INVENTION

It is, accordingly, an object of the present invention to produce sugar by a transformation process which does not suffer the disadvantages of known processes and which may, if desired, be operated as a continuous process.

I have now surprisingly discovered that transformation can be carried out more efficiently by subjecting the sugar syrup to a sufficiently high shear force to induce catastrophic nucleation and that, if the sugar syrup is subjected to a sufficiently high shear force, the force need not be applied throughout the crystallization of the sugar. In the process of the present invention, the sugar syrup is subjected to a shear force having a velocity gradient of at least 5000 cm/sec/cm, in contrast with prior art transformation processes, where the sugar syrup has been subjected to a shear force having a velocity gradient substantially below 1000 cm/sec/cm. The process of the invention allows sugar transformation to be carried out without the disadvantages of prior art processes and, in particular, a transformation process in accordance with the present invention may be carried out continuously.

Thus, the present invention consists in a process for the crystallisation of sugar from a supersaturated sugar syrup, in which the syrup is subjected to a shear force having a velocity gradient of at least 5000 cm/sec/cm to induce catastrophic homogeneous nucleation of sugar, and the syrup is thereafer allowed to crystallise. The crystallisation preferably takes place in a thin layer without agitation or without substantial agitation.

BRIEF DESCRIPTION OF DRAWINGS

The accompanying drawing is a flow diagram of a process in accordance with the invention, using a colloid mill.

DETAILED DESCRIPTION OF INVENTION

Provided that the equipment used to induce nucleation of the sugar syrup is capable of generating a shear force having a velocity gradient of at least 5000 cm/sec/cm, any conventional mechanical shear equipment may be used. However, the shear force preferably has a velocity gradient of at least 10,000 cm/sec/cm and more preferably at least 20,000 cm/sec/cm and it is, accordingly, preferred that the equipment should be capable of generating at least such a shear force. We have found that equipment which gives particularly good results in the process of the present invention is of the high-speed, small clearance type, such as colloid mills or homogenizers. If a colloid mill is employed, its nature is not critical to the process of the invention, since the intensive disruptive action produced by any colloid mill will bring about the catastrophic homogeneous nucleation necessary. However, we have found it convenient to use a cone-type colloid mill and a suitable commercially available mill of this type is the Fryma MZ in-line colloid mill; this is capable of generating a shear force having a velocity gradient of about 30,000 cm/sec/cm. Disc-type colloid mills may also be used in the process of the invention to produce a highly desirable product. Alternatively, any homogenizer may be used provided that it is capable of generating a shear force having a velocity gradient of at least 5000 cm/sec/cm. An example of a commercially available homogenizer of this type is the Silverson in-line mixer emulsifier; this is capable of generating a shear force of about 80,000 cm/sec/cm.

The equipment generating the shear force is preferably arranged to operate with the sugar syrup passing through it as fast as possible; in any case, it should operate at such a speed that the nucleated syrup is discharged before substantial, if any, crystallisation has taken place.

In order to effect catastrophic nucleation of the sugar syrup, the required residence time of the syrup in the high shear equipment for optimum results is inversely proportional to the velocity gradient of the shear force. Thus, for example, in a colloid mill, which typically operates at a velocity gradient of about 30,000 cm/sec/cm, the preferred residence time is from 0.05 to 0.5 second, about 0.25 second being more preferred, whereas, in a homogenizer such as the Silverson in-line mixer emulsifier, which typically operates at a velocity gradient of about 80,000 cm/sec/cm, the preferred residence time is from 0.0001 to 0.001 second a residence time of about 0.0005 second giving good results. In general, the equipment is preferably operated so that the residence time of the sugar syrup in it is no more than 1 second.

The temperature of the sugar syrup entering the high shear equipment is preferably from 115° to 135°C, although the optimum temperature will depend upon a number of factors, including concentration of sugar and level of impurities in the syrup. The desired concentration of sugar in the syrup starting material may be achieved by methods well known in the art. The following Table shows the heat required for substantially complete vaporisation of water at various concentrations of sugar in the syrup and the heat available from crystallisation at various temperatures and various concentrations.

TABLE

| g sugar per 100 g solution | Heat required: latent heat of vaporisation KJ | Heat available from crystallisation | | |
|---|---|---|---|---|
| | | ΔH at 110°C KJ | ΔH at 120°C KJ | ΔH at 130°C KJ |
| 86 | 31.6 | | | |
| 87 | 29.4 | | | 26.9 |
| 88 | 27.1 | | | 27.3 |
| 89 | 24.9 | | 20.9 | 27.6 |
| 90 | 22.6 | 16.2 | 21.1 | 27.9 |
| 91 | 20.3 | 16.4 | 21.3 | |
| 92 | 18.1 | 16.6 | 21.6 | |
| 93 | 15.8 | 16.7 | 21.8 | |

Where the heat available from crystallisation is less than the latent heat of vaporisation, satisfactory transformation will not be achieved. It will, therefore, be seen that, the higher the concentration of sugar in the sugar syrup, the lower is the required temperature. For example, when using a sugar syrup having a concentration of 90°Bx(i.e. 90 grams of sugar per 100 grams of syrup), a temperature of at least 123°C is required; on the other hand, when the concentration is 93°Bx, a temperature of 110°C is adequate. When the initial concentration of the sugar syrup is achieved by boiling at atmospheric pressure, a concentration of about 90°Bx can normally be achieved and such a concentrated sugar syrup will normally transform satisfactorily at temperatures above 123°C.

In practice, it is found that, at temperatures below 125°C, some auxiliary drying of the transformed sugar is necessary, whereas at higher temperatures, control of crystallisation is difficult. However, the optimum temperature and concentration for any particular starting material can easily be determined by simple experimentation.

The nucleated syrup is preferably discharged from the high shear equipment, e.g. colloid mill, onto a collector to which the crystallised sugar is preferably not adherent. If, as will normally be the case, the process of the present invention is carried out continuously, the collector will preferably be a moving belt conveyor, suitably a steel or reinforced plastics (e.g. polytetrafluoroethylene-impregnated fibre)band. The collector may initially be heated to assist evaporation of water, but this may not be necessary in subsequent operation.

The very rapid and intensive disruptive forces exerted by the high shear equipment on the sugar syrup cause catastrophic and essentially homogeneous nucleation of the syrup. Since, however, the syrup is preferably immediately thereafter discharged from the high shear equipment, the actual crystallisation does not occur in this equipment and thus clogging is avoided. Moreover, in the preferred embodiment of the process of the invention, the exothermic crystallisation takes place on a moving belt conveyor and there is thus no compacting of the crystallising sugar such as would occur were the crystallisation to take place within the confines of a crystallisation vessel. As a result, the product is a soft, moist, friable solid with an "open" structure; this "open" structure is essentially micro-cellular and is caused by the blowing effect of evaporating water. The solid may be broken up into particles of the size desired by the consumer using any convenient method. For example, the solid could be roughly broken up by a shovelling action and then passed through a Raymond mill. Alternatively, the solid could be extruded by a roller onto one or more grids, wedge wire screens or perforated plates in a manner similar to that known for confectionery vermicelli production. The latter is the preferred process.

At the end of the process, the sugar is preferably dried to remove any residual moisture. Any drier commonly used in the sugar industry may be employed, e.g. a drum drier operating at a temperature of, for example, about 60°C. Although the product of the present invention will, in common with the product of any transformation process, contain all of the impurities which were present in the original syrup, this is often acceptable or, indeed, desirable where a "brown" sugar is required. The bulk density of the product will depend upon the way in which it is broken up and may vary from 0.4 to 0.9 g/cm$^3$. The process of the present invention thus has the added advantage that it enables sugar having a much lower bulk density than that conventionally produced to be obtained cheaply and easily.

The nature of the product will depend to some extent upon the nature of the impurities which it contains and this, in turn, will depend upon the nature of the impurities in the original syrup. In principle, the process of the invention can be applied to the sugar solutions obtained at any stage in a conventional sugar refinery and may, indeed, also be used after re-purification of sugar which has been contaminated after production. However, as the level of impurities increases, so it becomes more difficult to achieve sufficiently rapid transformation and, if the level of impurities is about 15%, transformation will be incomplete. Accordingly, we prefer that the sugar syrup employed in the process of the invention should contain impurities in an amount less than 15% by weight of solids.

The invention is further illustrated with reference to the accompanying drawing, which is a flow diagram illustrating a preferred process according to the present invention.

A sugar syrup is stored hot in tank 1. The sugar syrup may, for example, have a solids content from 50% by weight to 80% by weight and may be any sugar syrup produced in a conventional refinery or may be re-dissolved, previously processed sugar. From the tank 1, the syrup is passed to a plate evaporator 2, where it is concentrated, by evaporation of water, to form a concentrated sugar syrup which may, for example, have a solids content of 90% by weight or more. The evaporator 2 is heated by steam, which may be low pressure steam (e.g. about 40 psi g) or high pressure steam (e.g. about 150 psig) fed through pipeline 3. Condensed steam is run off through pipeline 4, whilst the concentrated syrup, preferably at a temperature greater than 123°C, is passed through colloid mill 5, in which it is catastrophically nucleated. The syrup emerges as a cream 6, in which crystals are in the process of forming, and flows onto a conveyor band 7, which is optionally heated, enclosed in a chamber 8, fitted with a vapour extractor 9 to remove the water vaporised from the transforming sugar 10. Transformation will normally take place over a period of about 5 minutes. The length of the conveyor band and its speed should be so chosen that the sugar has a residence time of at least 1.5 minutes on the band before being removed from the band by scraper 11. The sugar is then particulated by roller 12 on a wire mesh or perforated plate 13. The particulate sugar, is then optionally passed through a mill (not shown) before being discharged, by chute conveyor 14, to a conventional drum drier 15.

The invention is further illustrated with reference to the following Examples.

EXAMPLE 1

Using the apparatus shown in the accompanying drawing, a sugar syrup prepared by dissolving white sugar in water and containing about 25% water, 99.96% sugar (by weight of solids) and 0.015% ash (by weight of solids) was stored at 85°C in tank 1. The syrup was passed from tank 1 at a flow rate of 70 kg/hour to plate evaporator 2, where it was concentrated, by means of steam at a pressure of 40 psig fed through pipeline 3, from 65% solids to 90% solids. The concentrated syrup, at a temperature of about 125°C was then passed through colloid mill 5 (Fryma Colloid Mill MZ 80/R), running at about 3000 rpm with a clearance between the cones of 300 microns. The syrup was subjected to a shear force having a velocity gradient of about 30,000 cm/sec/cm and a mean residence time of about 0.25 second, which caused catastrophic nucleation. The resulting cream, in which crystals were already forming, immediately thereafter emerged from the colloid mill and flowed onto conveyor band 7, forming a layer about 15 mm deep. The length of the conveyor band was 1.2 m and the sugar had a residence time of 2 minutes on the band before being removed by scraper 11. At this stage, the sugar was semi-dry and was easily particulated by the action of roller 12 on a 1 cm wire mesh 13. The particulate sugar, which was still slightly damp, was then passed through a Raymond laboratory mill without screen and thereafter dried in a conventional drum drier for about 15 minutes at 60°C to a moisture content of about 0.5%. 45 Kg/hour of free flowing, particulate sugar were obtained.

EXAMPLE 2

Following the procedure described in Example 1, a cane sugar syrup containing 30% water, 90.36% sugar (by weight of solids) and 3.27% ash (by weight of solids) was concentrated to 91% solids at 126°C. The concentrated syrup was then nucleated in the same colloid mill and under the same conditions as were used in Example 1 to produce a nucleated cream. This was allowed to remain on the conveyor band for about 4 minutes and then particulated through a 1 cm wire screen and subsequently through a Raymond laboratory mill fitted with a 4 mm mesh. The particulated sugar was then dried for 15 minutes at 60°C in a conventional drum drier. The resulting brown sugar had a moisture content of 0.85% by weight, was free flowing and had desirable flavour characteristics.

EXAMPLE 3

A cane sugar syrup containing 32% water and 99.96% sucrose (by weight of solids) was concentrated in 90% solids in a plate evaporator, as described in Example 1. The resulting concentrated syrup, at 125°C, was passed through a 0.5 hp Silverson in-line mixer emulsifier, where it was castastrophically nucleated. The shear force in the mixer emulsifier had a velocity gradient of about 80,000 cm/sec/cm and a mean residence time of about 0.0005 second. The resulting nucleated cream was pumped immediately onto a moving band, where it remained for 4 minutes, after which most of the transformation had taken place and the product was in the form of semi-dry fondant-like lumps. These were rolled through a wedge wire screen of 2 mm aperture and then dried in a rotary drum drier for 15 minutes at 60°C. The dried product was particulate and free-flowing.

I claim:

1. A process for the crystallisation of sugar from a supersaturated sugar syrup, in which the syrup is subjected in a nucleation zone to a shear force having a velocity gradient of at least 5000 cm/sec/cm to induce catastrophic homogeneous nucleation of sugar, the syrup is discharged from said nucleation zone before substantial crystallization has taken place, and the syrup is thereafter crystallised to produce crystalline sugar.

2. A process as claimed in claim 1, wherein said velocity gradient is at least 10,000 cm/sec/cm.

3. A process as claimed in claim 1, wherein the velocity gradient is at least 20,000 cm/sec/cm.

4. A process as claimed in claim 1, wherein the shear force is applied by a colloid mill.

5. A process as claimed in claim 4, wherein said velocity gradient is at least 20,000 cm/sec/cm.

6. A process as claimed in claim 1, wherein the shear force is applied by means of a homogeniser.

7. A process as claimed in claim 6, wherein the shear force has a velocity gradient of at least 20,000 cm/sec/cm.

8. A process for the crystallisation of sugar from a supersaturated sugar syrup, in which the syrup is subjected, in high shear equipment, to a shear force having a velocity gradient of at least 5000 cm/sec/cm to induce catastrophic homogeneous necleation of sugar and the syrup is immediately thereafter discharged from the equipment before substantial crystallization has taken place and allowed to crystallise.

9. A process as claimed in claim 8, wherein the nucleated syrup is discharged from the equipment onto a moving belt conveyor.

10. A process as claimed in claim 8, wherein the velocity gradient is at least 20,000 cm/sec/cm.

11. A process as claimed in claim 8, wherein the syrup contains less than 15% by weight impurities.

12. A process as claimed in claim 8, wherein the supersaturated sugar syrup has a temperature of at least 123°C and a sugar concentration of at least 90°Bx.

13. A process as claimed in claim 8, wherein the residence time of said sugar syrup in said high shear equipment is less than about 1 second.

14. A process for crystallization of sugar from a supersaturated sugar syrup, in which the syrup is passed through a colloid mill to induce catastrophic homogeneous nucleation of sugar, the syrup is discharged from the mill before substantial crystallization has taken place and the syrup is thereafter crystallized to produce crystalline sugar.

15. In a process for the refining of sugar, the steps of: concentrating a non-concentrated sugar solution to form a supersaturated sugar syrup; subjecting in a nucleation zone the supersaturated sugar syrup to a shear force having a velocity gradient of at least 5000 cm/sec/cm to induce catastrophic homogeneous nucleation of sugar; discharging the syrup from said zone before substantial crystallization has taken place; and thereafter crystallizing the sugar from the nucleated syrup.

16. A process as claimed in claim 1 wherein the residence time of said sugar syrup in said nucleation zone is less than about one second.

17. A process as claimed in claim 4 wherein the residence time in said nucleation zone is from 0.05 to 0.5 second.

18. A process as claimed in claim 6 wherein the residence time in said nucleation zone is from 0.0001 to 0.001 second.

19. A process as claimed in claim 14 wherein the residence time of said sugar syrup in said colloid mill is from 0.05 to 0.5 second.

20. A process as claimed in claim 15 wherein the residence time of said sugar syrup in said nucleation zone is less than about 1 second.

* * * * *